US005233140A

United States Patent [19]

Asano et al.

[11] Patent Number: 5,233,140

[45] Date of Patent: Aug. 3, 1993

[54] MULTIPLE SWITCH ASSEMBLY WITH INTERLOCK

[75] Inventors: Tsugio Asano; Yasuji Nojiri, both of Tokyo, Japan

[73] Assignee: Toyo Denso Kabushiki Kaisha, Tokyo, Japan

[21] Appl. No.: 797,071

[22] Filed: Nov. 25, 1991

[30] Foreign Application Priority Data

Nov. 30, 1990 [JP] Japan ..... 2-129380[U]

[51] Int. Cl.[5] ..... H01H 9/20

[52] U.S. Cl. ..... 200/5 E; 200/5 EA

[58] Field of Search ..... 200/5 R, 5 A, 5 E, 5 EA, 200/5 EB, 50 C; 74/471 XY, 471 R, 483 PB

[56] References Cited

U.S. PATENT DOCUMENTS

| | | | |
|---|---|---|---|
| 2,748,205 | 5/1956 | Forstrom | 200/5 E |
| 3,780,236 | 12/1973 | Gross | 200/5 EA |
| 3,796,844 | 3/1974 | Osika | 200/5 E |
| 4,499,342 | 2/1985 | Nakayama | 200/5 E |
| 4,539,860 | 9/1985 | Johnston et al. | 200/5 EA X |

*Primary Examiner*—J. R. Scott

[57] ABSTRACT

A switch unit has at least a pair of switches and a pair of push buttons arranged corresponding to the pair of switches. A lock member is arranged between the pair of the push buttons to engagingly lock the movement of one of the push buttons at the time of an operation of the other of the push buttons, whereby an unexpected concurrent operations of the adjoining push buttons may be effectively prevented.

8 Claims, 5 Drawing Sheets

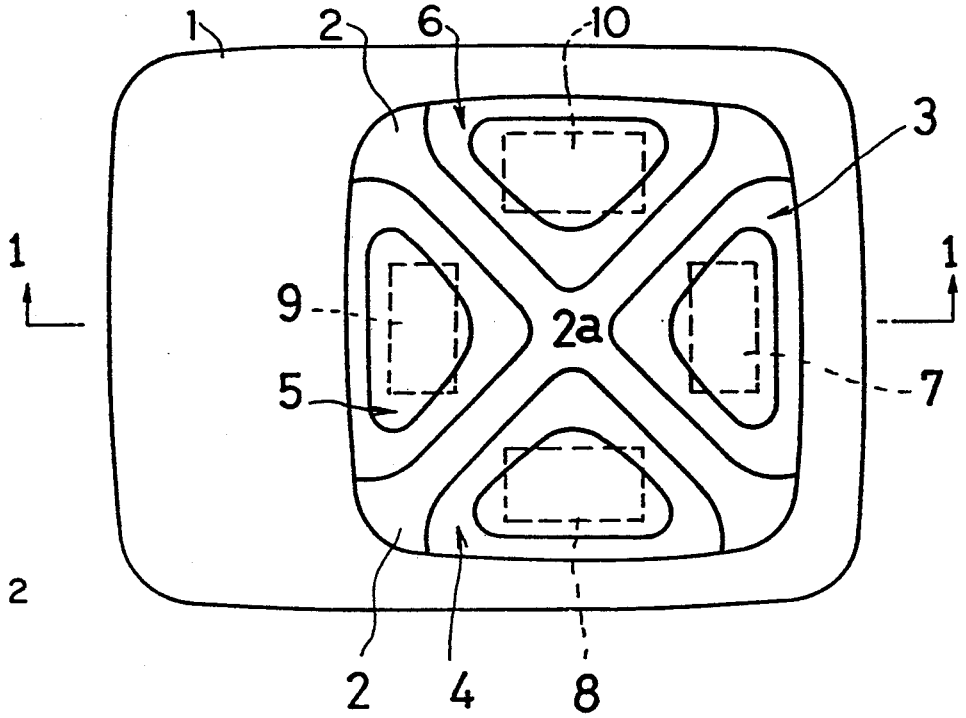
FIG. 2
FIG. 3
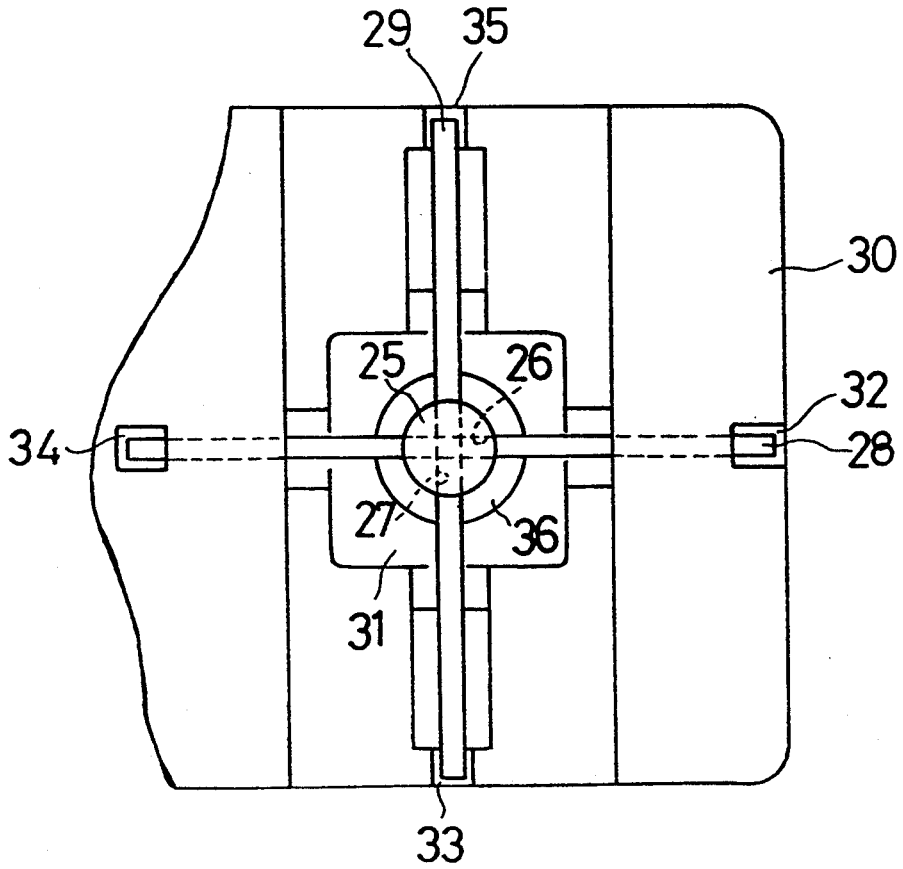

MULTIPLE SWITCH ASSEMBLY WITH INTERLOCK

BACKGROUND OF THE INVENTION

1. Field of the Invention

The present invention relates to a switch unit having a plurality of switches arranged close to each other, and more particularly to a lock means thereof for mechanically preventing a concurrent operation with respect to the adjoining switches.

2. Description of the Prior Art

Among conventional switch units in use, for example, for an automobile, there is known a type of a switch unit with a pair of push buttons to be independently operated which are oppositely and adjacently arranged to each other and a pair of switches to be actuated by the respective push buttons are provided corresponding thereto.

In the construction as mentioned above, the pair of the push buttons are susceptible to be unexpectedly operated concurrently due to their close arrangement. Therefore, it has long been desired to provide a switch unit of a simple construction capable of avoiding such unexpected concurrent operation. However, when electronic means are employed for programmably carrying out a switching operation, countermeasures to be taken at the time of the concurrent operation will become difficult at times. For that reason, mechanical means will be more preferrable to be employed so as to prevent the concurrent operation without any difficulty.

SUMMARY OF THE INVENTION

It is therefore an object of the present invention to provide an improved switch unit which has mechanical means of a simple construction capable of preventing an unexpected concurrent operation of adjoining switch operation members.

It is another object of the present invention to provide a switch unit with a reliably operable lock means for assuredly keeping one of switch operation members from being actuated during operation of the other switch operation member.

It is a further object of the present invention to provide a switch unit which is provided with means for having a lock member accurately actuated to its operative lock position and stably maintained in its inoperative neutral position.

To this end, according to the present invention, there is provided a switch unit comprising a casing, at least a pair of switches arranged opposite to each other within the casing and adapted to be actuated independently of each other, a pair of switch operation means arranged corresponding to the pair of the switches to operate each of the switches independently, and a lock means whose position is movable with respect to and between the pair of the switch operation means and adapted to lock the movement of one of the switch operation means in cooperation with the other of the switch operation means during the operative movement of the latter.

According to the present invention, there is also provided a switch unit comprising a casing, at least a pair of switches arranged in an opposed relationship to each other within the casing and adapted to be actuated independently of each other, a pair of operation means arranged corresponding to the pair of the switches so as to separately operate each of the switches, and a lock member of a substantially triangular or trapezoidal shape provided with an apex positioned between the pair of operation means and with a pair of oppositely downwardly inclined guide surfaces each positioned in alignment with the operative direction of the operation means in the neutral position thereof, wherein upon operation of one of the operation means the lock member is moved at one of the guide surfaces thereof toward the other of the operation means thereby causing the other of the guide surfaces thereof to be engagingly in contact with the other of the operation means so as to lock the same in its inoperative position.

In one aspect of the present invention, the switch unit has four switches in pairs each arranged at an interval of 90 degrees with respect to each other, and four switch operation means in pairs each arranged at an interval of 90 degrees corresponding to the switches, wherein a lock member is in the form of a quadrangular pyramid or with four inclined guide surfaces to be engagingly contacted with the four operation means respectively and movable in crossed four directions on a common horizontal plane.

In another aspect of the present invention, the switch unit is further provided with a spring for guiding the lock member to its operative position and for returning the lock member to its neutral inoperative position, whereby assuring the lock member of an accurate operation.

The above and other related objects and features of the present invention will become apparent from the following detailed description of preferred embodiments thereof, when the same is read in conjunction with the accompanying drawings.

BRIEF DESCRIPTION OF THE DRAWINGS

FIG. 2 is a top plan view of FIG. 1;

FIG. 3 is a fragmentary enlarged view, as viewed from an arrow B of FIG. 1;

DETAILED DESCRIPTION OF THE PREFERRED EMBODIMENTS

Figure 1:
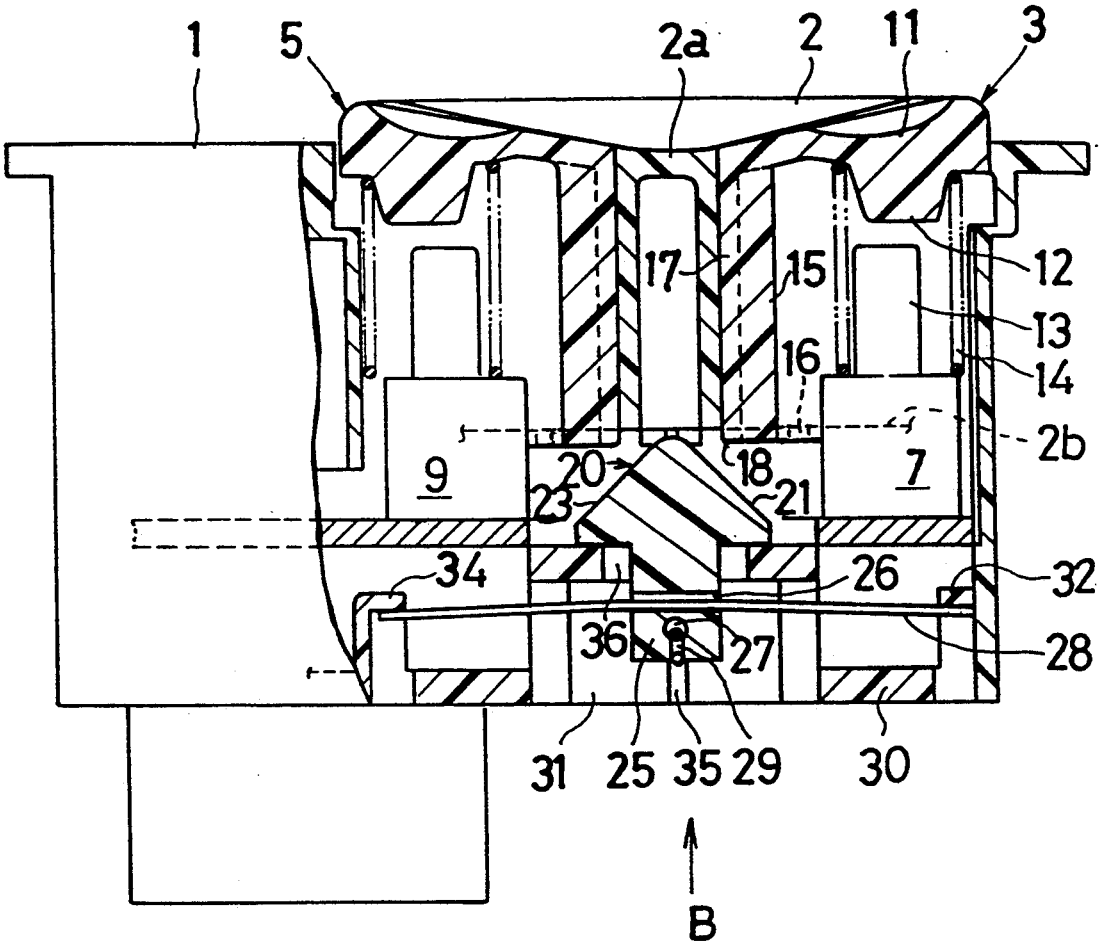
FIG. 1 is a side elevational view, partly in cross section taken along line I—I of FIG. 2, of a first embodiment pursuant to the present invention.

Referring now more particularly to drawings, wherein like reference numerals designate like or corresponding parts throughout, there is illustrated a first embodiment of a switch unit of a push button type which has four switches adapted to be used for adjustably controlling, for example, the movement of a steering wheel for an automobile in an upward and downward directions as well as in a forward and backward directions thereof. As shown in FIG. 2, a casing 1 is formed with a generally X-shaped partition wall 2 which extends diagonally from a central intersection 2*a* thereof to four directions at a right angle so as to define four substantially triangular openings. The triangular openings are arranged around the central intersection 2a at the same interval of 90 degrees with respect to the adjoining openings thereof. Four push buttons 3, 4, 5 and 6 are installed in the respective four openings in a vertically movable fashion. Within the casing 1, switches 7, 8, 9 and 10 are accommodated and positioned under the push buttons 3 to 6 so to be individually operated by the corresponding one of the push buttons 3 to 6, respectively. Each of the switches 7 to 10 is constituted in the form of a micro-switch.

As clearly shown in FIG. 1, the push button 3 of a substantially inverted L-shape in section is formed on the internal surface of a press portion 11 thereof with a boss 12 which is in a face to face relationship with an actuator 13 of the switch 7 in such a manner that, upon operation of the push button 3, the boss 12 presses the actuator 13 downwards so as to turn the switch 7 on. A return spring 14 is arranged between the boss 12 and the actuator 13 and urges them towards the opposite directions from each other thereby to have the push button 3 kept in its initial inoperative position. On the lower portion of a standing wall 15 of the push button 3, there is provided a claw 16 which is possible to be engaged to a lower partition wall 2b in order to prevent the push button 3 from getting out of place. In abutment with the central intersection 2a, a vertically extending guide rib 17 is formed on the standing wall 15 and slidably engaged with a guide groove which extends throughout the whole length of the central intersection 2a in the vertical direction thereof, so that the up and down movement of the push button 3 may be conducted along the vertical extension of the central intersection 2a. The lower end of the guide rib 17 serves as an abutment portion 18 to be brought into contact with a slant guide surface 21 which is formed on the head of a lock member 20.

The explanation made hereinbefore with reference to the push button 3 may be similarly applied, as it is, to the push buttons 4, 5 and 6, since these buttons are just alike in construction to the push button 3.

Figure 4:
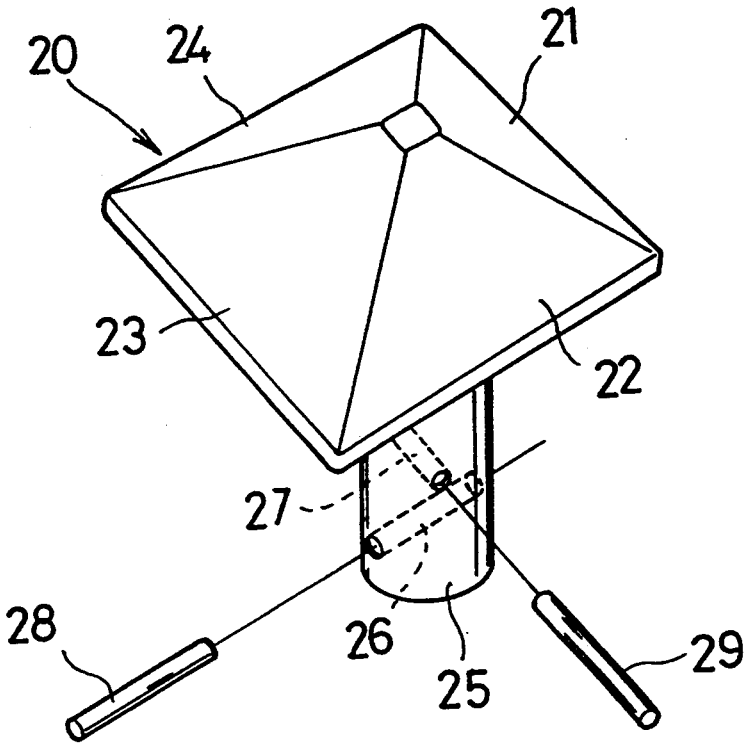
FIG. 4 is an exploded perspective view showing an essential part of the invention.
Figure 5:
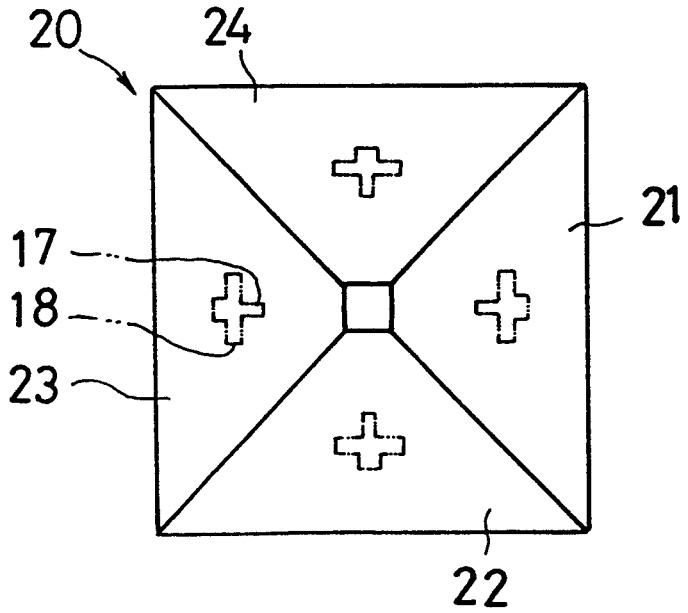
FIG. 5 is a top plan view of the essential part of the invention.
Figure 6:
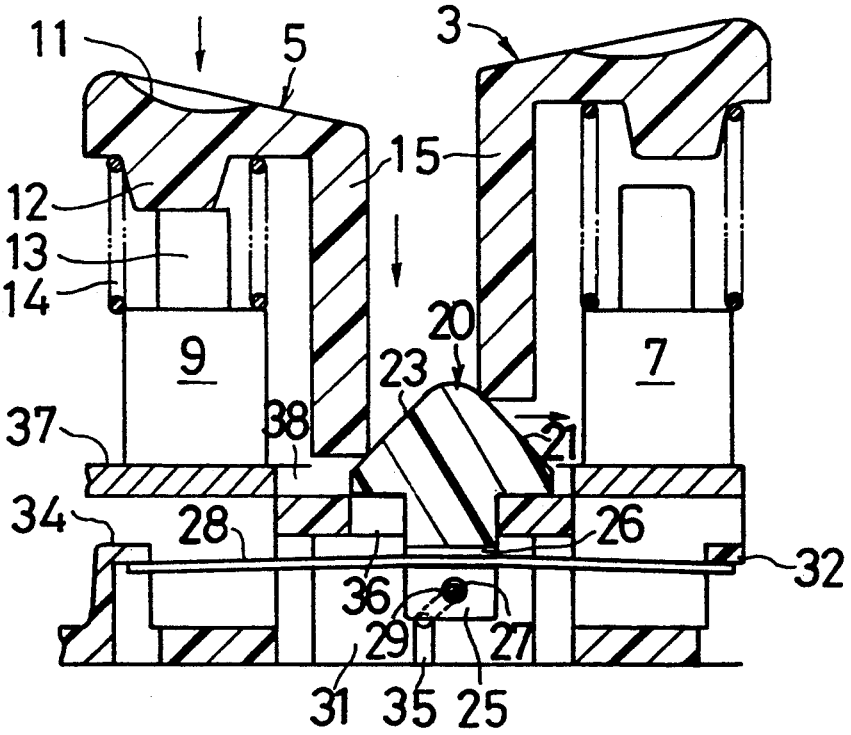
FIG. 6 is an enlarged sectional view for explaining an operation of the essential part of the invention.

As shown in FIGS. 3 and 4 in an enlarged scale, the head of the lock member 20 is formed of a quadrangular pyramid or frustum with four slant guide surfaces 21, 22, 23 and 24 of generally triangular shape. Each pair of the opposed slant guide surfaces 21 and 23 or 22 and 24 are inclined downwards in the opposite directions to each other. In the neutral inoperative position of the lock member 20, each of the slant guide surfaces 21 to 24 is situated in alignment with the operative direction of each push button 3 through 6 corresponding thereto in such a condition that in operation the respective abutment portions 18 of the push buttons 3 to 6 are brought into contact with the corresponding one of the slant guide surfaces 21 to 24. A leg portion 25 of the lock member 20 has a circular cylindrical shape and is provided at the different elevations of the midway thereof with two horizontal guide bores 26 and 27 which are directed normal to the vertical longitudinal axis of the leg portion 25. These guide bores 26 and 27 extend normal to each other. Pierced through the guide bores 26 and 27 are sticklike springs 28 and 29 smaller in diameter than these bores. The leg portion 25 of the lock member 20 extends downwards into a vertically extending recess 31 formed in a comparatively larger diameter on the bottom of the casing 1. The lock member 20 is movable along the sticklike springs 28 and 29 in crossed four-way directions on the same horizontal plane.

Four engaging portions 32, 33, 34 and 35 in the form of an upwardly extending slit or groove are formed at an interval of 90 degrees on the bottom of the casing 1 and positioned radially outwardly of the recess 31 on imaginary extended axes of the guide bores 26 and 27. One of the springs 28 and 29 is held at the opposite ends thereof by the engaging portions 32 and 34 and the other is held at the opposite ends thereof by the engaging portions 33 and 35. On the top wall of the recess 31 is provided an aperture 36 through which the leg portion 25 is inserted thereby to be regulated its movement in a horizontal plane to the predetermined extent. Reference numeral 37 designates a printed circuit substrate which is provided with a wide aperture 38. The head of the lock member 20 is projected upwards through the aperture 38. Around the aperture 38, the switches 7 through 10 are mounted on and connected to the circuit substrate 37.

An explanation will next be given on the operation of this embodiment. At first, when pressing down the push button 5 against the return spring 14, the abutment portion 18 goes down to be brought into contact with the slant guide surface 23. Further pressing of the push button 5 brings the boss 12 into contact with the actuator 13 so as to turn the switch 9 on. At the same time, the lock member 20 is slidably guided, as resiliently deforming the spring 29, along the spring 28 towards the push button 3 so as to cause the slant guide surface 21 to come in contact engagingly with the abutment portion 18 of the push button 3. Thus, the push button 3 is locked its movement in the pressed operative position of the push button 5 and prevented from being actuated concurrently with the push button 5. Upon releasing the pressing force, the push button 5 is returned to its initial inoperative position by the return spring 14, and simultaneously the boss 12 moves away from the actuator 13 thereby turning off the switch 9. The lock member 20 is then returned to its neutral position through the elastic restoring force of the spring 29. When the push buttons 3 and 5 are pressed at one time, the respective abutment portions 18 thereof simultaneously come into contact with the slant guide surfaces 21 and 23 to be halted there. Therefore, the lock member 20 is kept in its neutral position and neither of the switches 7 and 9 is turned on. The explanation made hereinabove with respect to the push buttons 3 and 5 will be also applicable to an operative relationship between the push buttons 4 and 6. In the latter case, the lock member 20 moves along and is guided by the spring 29, having the spring 28 deformed. With this crossed arrangement of two springs 28 and 29, the lock member 20 may be always guided by either one of the springs 28 and 29 during movement in the four-way directions on the horizontal plane while being always biassed to the neutral position thereof. For having the springs 28 and 29 arranged within the casing 1 there is not required much space in a vertical direction thereof so that a sufficient space may be maintained inside the casing 1 for arrangement of such component parts as the lock member 20 and the switches 7 through 10. Further, the lock member 20 may be maintained stable in its predetermined position through such an elastic force of the springs 28 and 29 as holding the lock member 20 in the neutral position and urging the lock member 20 against the top wall of the recess 31.

Figure 7:
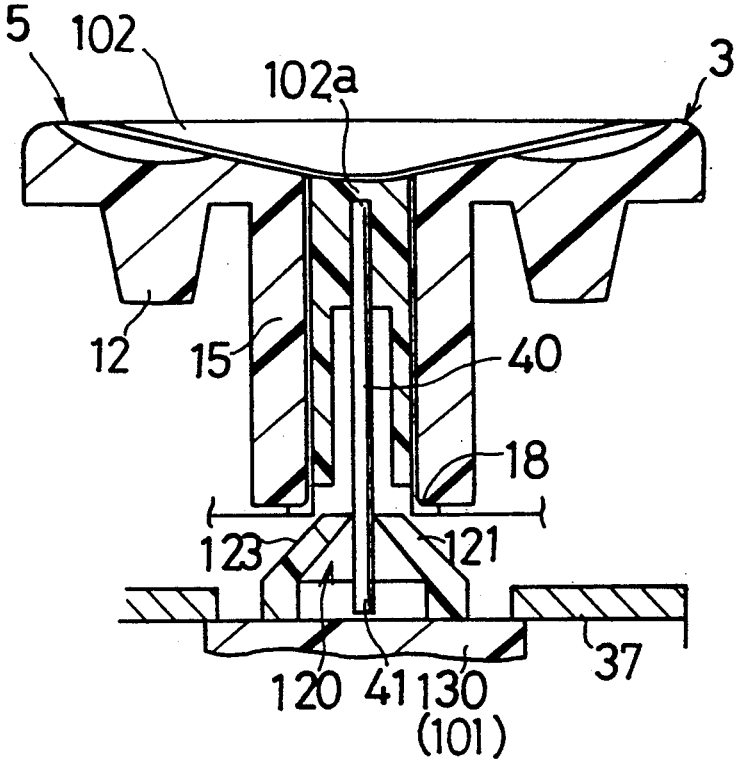
FIG. 7 is an enlarged sectional view showing an essential part of a second embodiment pursuant to the present invention.
Figure 8:
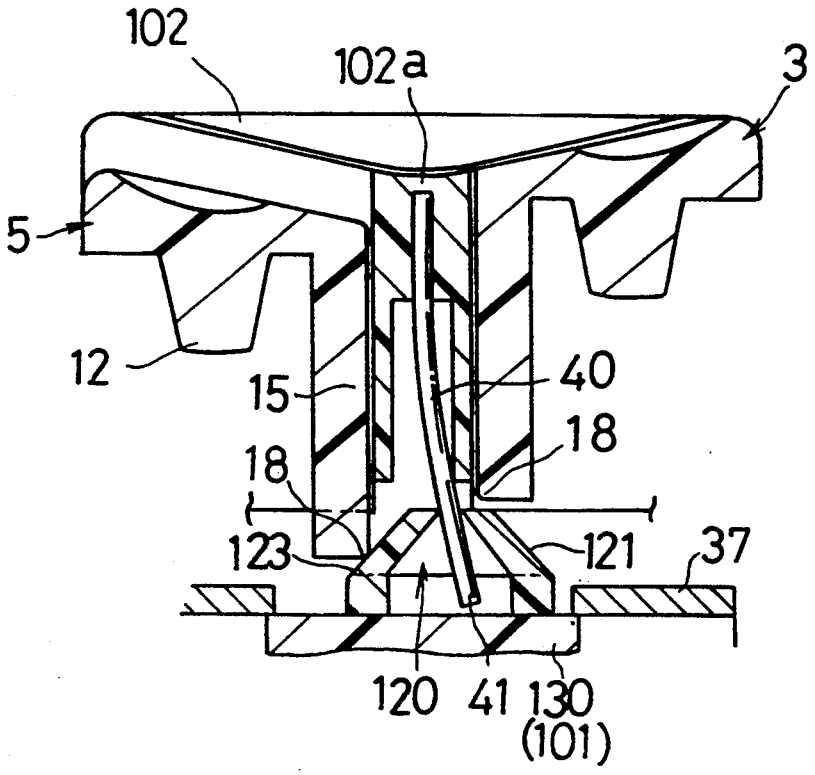
FIG. 8 is an enlarged sectional view of the essential part, illustrated in an operative position.

Referring now to FIGS. 7 and 8, there is illustrated a second embodiment, wherein a single spring 40 is utilized in order to return a lock member 120 to the neutral position thereof in lieu of a set of the springs 28 and 29 in the first embodiment. When explaining this embodiment by using like reference numerals with respect to like or corresponding component parts to the first embodiment, the spring 40 is located on and extends along a vertical longitudinal axis of a central intersection 102*a* of a partition wall 102. The upper end of the spring 40 is fixedly secured to the inside wall of the central intersection 102*a* and the lower end thereof is engaged with a lock member 120. The lock member 120 is formed similar to the head of the lock member 20 in the first embodiment and selectively movable on a bottom 130 of a casing 101 in either of the four directions crossed at a right angle.

When pressing the push button 5 downwards as viewed in FIG. 8, a slant guide surface 123 is pushed by the abutment portion 18 so as to cause the lock member 120 to move towards the push button 3 whereby preventing the downward movement of the push button 3. In accordance with the movement of the lock member 120, the lower end of the spring 40 is resiliently deformed. When releasing the pressing force from the push button 5, the lock member 120 is returned to the initial neutral position by the elastic restoring force of the spring 40. The operation as explained above is identically carried out in case the push button 4 or 6 is operated with reference to each other. As explained above, only a single spring is used for actuating the lock member 120 to its neutral position so as possible to make simple in construction. Also, there is not required much space on a horizontal plane for having the spring 40 arranged within the casing 101 so that the component parts such as the switches 7 through 10, the lock member 120 or the like may be assuredly arranged within a limited space of the casing 101.

While there has been described what is considered to be the preferred embodiment of the present invention, it is to be understood that various modifications may be made therein. For example, the switch unit of the present invention is capable of employing a set of two switches in lieu of a set of four switches. In this case, a lock member of a triangle or trapezoid in cross section is formed with a pair of oppositely downwardly inclined guide surfaces an apex of which is positioned between operation members for these two switches in the neutral state thereof. A locking operation of one of the operation members with respect to the other will be effected in the same way as explained in the first or second embodiment. It is also to be understood that the spring for returning the lock member to its original neutral position is not necessarily required and that the springs 28 and 29 or 40 are possible to be eliminated, if desired. On the other hand, various changes in the shape and arrangement of the spring may be made, for example, in the form of a coiled spring of a cross shape or the like.

What is claimed is:

1. A switch unit comprising:

a casing, a pair of switches, oppositely arranged within said casing, for independent actuation, a pair of switch operation means for independently operating each of the pair of switches, and lock means, movably positioned and interposed between the pair of switch operation means, for locking a movement of one of the switch operation means in cooperation with the other of said switch operation means during operative movement of the other of the switch operation means, wherein said casing includes a first spring for returning the other of the switch operation means to an initial inoperative position, and wherein said lock means includes a second spring for returning said lock means to a neutral position.

2. A switch unit comprising:

a casing, a pair of switches, oppositely arranged within said casing, for independent actuation, a pair of switch operation means for independently operating each of the pair of switches, and lock means of a substantially triangular or trapezoid shape, provided with an apex, positioned between the pair of switch operation means, and a pair of opposite downwardly inclined guide surfaces, each aligned with an operative direction of the pair of switch operation means in a neutral position, wherein when one of the switch operation means is operated, said lock means is pushed against one of the guide surfaces to move the lock means such that the other guide surface contacts and locks the other one of the switch operation means in an inoperative position.

3. A switch unit comprising:

a casing;

four switches, arranged in two pairs, each switch at an interval of 90 degrees with respect to the other three switches for independent activation, and four switch operation means, arranged in two pairs, corresponding to said four switches for independently operating each pair of switches, lock means of a substantially quadrangular pyramid or frustum shape with four inclined guide surface for contacting said four switch operation means, wherein when one of said four switch operation means is operated, one of the four inclined guide surfaces of said lock means is pushed to move said lock means such that the inclined guide surface opposite the pushed inclined guide surface contacts and locks the switch operation means opposite the operated switch operation means in an inoperative position.

4. The switch unit as set forth in claim 3, further comprising spring means for returning said lock means to a neutral position.

5. The switch unit of claim 4, wherein said spring means includes a spring extending in parallel with an operative direction of the pair of switch operation means and engaged at one end to said lock means and at the other end to said casing.

6. The switch unit of claim 4, wherein said lock means includes two guide bores extending normal to a vertical longitudinal axis and normal to each other, wherein said spring means includes two springs which pass through said two guide bores and cross each other to control the movement of said lock means in four directions.

7. The switch unit of claim 2, wherein said casing includes a first spring for returning the other of the switch operation means to an initial inoperative position, wherein said lock means includes a second spring for returning said lock means to a neutral position.

8. The switch unit of claim 7, wherein said second spring is a linear spring.

* * * * *